United States Patent [19]

Nakamoto et al.

[11] Patent Number: 4,943,555

[45] Date of Patent: Jul. 24, 1990

[54] IMAGE-RECEIVING SHEET

[75] Inventors: Mitsuharu Nakamoto; Kazuhiko Sano; Takashi Kawasawa, all of Kyoto, Japan

[73] Assignee: Dai Nippon Insatsu Kabushiki Kaisha, Japan

[21] Appl. No.: 265,502

[22] Filed: Nov. 1, 1988

[30] Foreign Application Priority Data

Apr. 21, 1987 [JP] Japan ..... 62-98214

[51] Int. Cl.[5] ..... B41M 5/18

[52] U.S. Cl. ..... 503/227; 8/471; 428/195; 428/913; 428/914

[58] Field of Search ..... 8/471; 428/195, 913, 428/914; 503/227

[56] References Cited

U.S. PATENT DOCUMENTS 4,839,338 6/1989 Marbrow ..... 503/227

*Primary Examiner*—Bruce H. Hess

*Attorney, Agent, or Firm*—Arnold, White & Durkee

[57] ABSTRACT

An image-receiving sheet which is used in combination with a heat transfer sheet having a dye layer containing a dye transferable through melting or sublimation with heat, characterized in that it has a receiving layer for receiving the dye transferred from the above-mentioned heat transfer sheet on one surface of a sheet substrate, and the weight of the solvent in the receiving layer is 1% or less of the weight of the solvent soluble components forming the receiving layer.

3 Claims, 1 Drawing Sheet

IMAGE-RECEIVING SHEET

BACKGROUND OF THE INVENTION

This invention relates to an image-receiving sheet. Attempts have been made to heat a heat transfer sheet having a dye layer containing a sublimable disperse dye therein in spots corresponding to image signals by thermal heads, etc., thereby forming an image comprising the dye transferred onto the surface of a resin-coated paper.

These image-receiving sheets have a constitution comprising a receiving layer which receives the dye transferred from the heat transfer sheet provided on the surface of a sheet substrate, and can produce a clear printed image.

However, in the image-receiving sheet of the prior art, an inconvenience frequently occurs that the image becomes vague during storage after printing, and also that the odor of solvent remains. These odors are particularly undesirable in the case when the printed sheet is used as wrapping for foods, etc.

SUMMARY OF THE INVENTION

An object of the present invention is to provide a good image-receiving sheet without such image vagueness after printing, and also without odor.

In order to solve the above task, the image-receiving sheet of the present invention is an image-receiving sheet which is used in combination with a heat transfer sheet having a dye layer containing a dye transferable through melting or sublimation with heat, characterized in that it has a receiving layer for receiving the dye transferred from the above-mentioned heat transfer sheet on one surface of a sheet substrate, and the weight of the solvent in the receiving layer is 1% or less of the weight of the solvent soluble components forming the receiving layer.

DETAILED DESCRIPTION OF THE INVENTION

Figure 1:
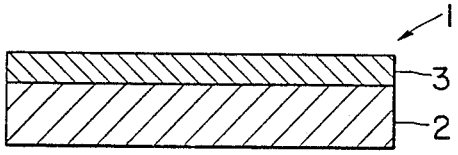
FIG. 1 is a longitudinal sectional view showing an embodiment of the image-receiving sheet of the present invention.

The receiving layer is formed by dissolving or dispersing the resin, etc. constituting the layer with the use of a solvent and applying the solution or dispersion according to a method such as printing, coating, etc. For the formation of a receiving layer, a larger amount coated when compared with that by general printing, etc. is required to be used for its function, whereby the content of the solvent also becomes larger. After the formation of the receiving layer, the sheet is dried by a dryer generally equipped on the printer or coater, but even after such drying, about 5 to 6% of the solvent has remained in the receiving layer. When printing is effected by use of such image-receiving layer together with a heat transfer sheet, a sharp image can be obtained during printing, but the remaining solvent will be diffused during storage, resulting in vagueness of the image.

It has also been found that the residual amount of volatile substances to the extent as mentioned above generates odor to the extent sensible by man.

Therefore, in the present invention, these problems of image vagueness and odor are intended to be solved by making the weight of volatile substances remaining in the receiving layer 1% or less of the weight of the synthetic resin forming the receiving layer.

The embodiments of the present invention are to be described below by referring to the drawings.

Figure 2:
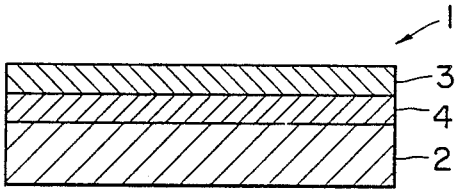
FIG. 2 is a longitudinal sectional view showing another embodiment of the image-receiving sheet of the present invention.

The image-receiving sheet 1 of the present invention has a receiving layer 3 on the surface of a sheet substrate 2, as shown in FIG. 1. Alternatively, as shown in FIG. 2, the image-receiving sheet 1 has an intermediate layer 4 between the sheet substrate 2 and the receiving layer 3, and thermal insulating property or cushioning property of the surface during image formation can be improved by the provision of the intermediate layer.

In the present invention, as the substrate, (1) synthetic paper or foamed plastics (polyolefin type, polystyrene type, and polyester type etc.), (2) pure paper, art paper, coated paper, cast coated paper, paper for wallpaper backing, paper impregnated with synthetic resin or emulsion, paper impregnated with synthetic rubber latex, paper having synthetic resin added internally, board paper, or natural fiber paper such as cellulose fiber paper, etc., (3) transparent or opaque films or sheets of various plastics such as polyolefin, polyvinyl chloride, polyethyleneterephthalate, polystyrene, methacrylate, polycarbonate, etc. can be used. Among them, the synthetic paper or foamed plastics of (1) is preferable, because it has a microvoid layer with a low thermal conductivity (in other words, high thermal insulating property) on its surface. Also, a laminated product according to any desired combination of the above (1) to (3) can be used. Representative examples of the laminated product are laminates of cellulose fiber paper and synthetic paper, or laminates of cellulose fiber paper and plastic film or sheet. Among them, laminates of cellulose fiber paper and synthetic paper are preferable, since thermal instability (stretching or shrinkage) possessed by synthetic paper is compensated for by cellulose fiber paper, and high printing heat sensitivity by low thermal conductivity possessed by synthetic paper can be exhibited. Also, in this combination, for achieving a good balance between the front and the back of the laminate, it is preferable to use a three-layer laminate of synthetic paper/cellulose fiber/synthetic paper, whereby printing curl can be reduced.

As the synthetic paper to be used in the laminate as described above, any paper conventionally available for the substrate of the image-receiving sheet can be used, but particularly a synthetic paper having a paper-like layer having fine voids provided thereon (e.g. a commercially available synthetic paper: Yupo, produced by Oji Yuka Synthetic Paper) is desirably used. Fine voids in the above paper like layer can be formed by, for example, stretching a synthetic resin under the state containing fine fillers or incompatible resins and oils. The image-receiving sheet constituted by use of a synthetic paper having a paper-like layer containing fine voids has the effect of high image density without coarseness of the image, when an image is formed by heat transfer.

This may be considered to be due to the fact that there is thermal insulating effect by fine voids to provide good heat energy efficiency and good cushioning property by fine voids on the above synthetic paper, thereby contributing to the receiving layer on which the image is formed. It is also possible to provide a paper-like layer containing the above voids directly on the surface of a core material such as cellulose fiber paper.

Other than cellulose fiber paper in the above laminate, a plastic film can also be used, and further, the above cellulose fiber paper laminated with a plastic film can be used.

As the method for laminating a synthetic paper with a cellulose fiber paper, for example, laminating with the use of adhesives known in the art, laminating by use of extrusion lamination, laminating by heat adhesion may be included, and also as the method for lamination of a synthetic paper with a plastic film, laminating according to the lamination method, the calendering method, etc. which simultaneously effect the formation of a plastic film may be employed. The above laminating means is suitably selected depending on the material to be laminated with the synthetic paper. As specific examples of the above adhesive, emulsion adhesives such as ethylene-vinyl acetate copolymer, polyvinyl acetate, etc., water soluble adhesives such as polyester containing carboxyl groups, etc. may be included and also as the adhesive for lamination, adhesives of organic solvent solution type such as polyurethane type, acrylic type, etc. may be included. These substrates should preferably have a thickness generally in the range of 30 -200 μm. When a transparent plastic film is used as the substrate, an image-receiving sheet suitable for OHP (overhead projector) or slide use can be obtained.

The material constituting the receiving layer in the present invention is one which can receive the image of a dye transferred from a heat transfer sheet, for example, a sublimable disperse dye and maintain the image formed by reception, and any material which has been used in the prior art for the receiving layer of this kind of image-receiving sheet. For example, synthetic resins (a) to (e) shown below can be used singly or as a mixture of two or more kinds:

(a) those having ester linkages:
polyester resin, polyacrylate resin, polycarbonate resin, polyvinyl acetate resin, styrene-acrylate resin, vinyl toluene-acrylate resin;

(b) those having urethane linkages:
polyurethane resin, etc.;

(c) those having amide linkages:
polyamide resin (nylon);

(d) those having urea linkages:
urea resin, etc.;

(e) others having linkages of high polarity:
polycaprolactone resin, polystyrene type resin, polyvinyl chloride resin, polyacrylonitrile resin, etc.

Alternatively, the receiving layer may be constituted of a mixed resin of a saturated polyester and a vinyl chloride/vinyl acetate copolymer.

The vinyl chloride/vinyl acetate copolymer resin may be preferably one containing 85 to 97% by weight of vinyl chloride component, having a polymerization degree of about 200 to 800. Also, the copolymer is not limited to the case when it consists only of vinyl chloride/vinyl acetate copolymer component, as those containing vinyl alcohol component, maleic acid component, etc. may also be available.

The receiving layer may be also constituted of a polystyrene type resin, including, for example, polystyrene type resins consisting of homopolymers or copolymers of styrene, α-methylstyrene, vinyl toluene, or styrene type copolymer resins which are copolymers of the above styrene type monomer with other monomers such as acrylic or methacrylic monomers such as acrylate, methacrylate, acrylonitrile, methacrylonitrile, etc.

Formation of the receiving layer 3 may be performed according to the known coating or printing method by use of a composition for the formation of a receiving layer obtained by dissolving or dispersing a material for formation of the receiving layer on a sheet substrate 2, or otherwise according to the method in which it is once formed temporarily on a carrier separate from the sheet substrate 2 and then transferred again onto the sheet substrate 2.

As the solvent to be used in forming such receiving layer, conventional solvents can be employed, including, for example, alcoholic solvents such as isopropyl alcohol, methyl alcohol, ethyl alcohol, n-butyl alcohol and the like; ketone solvents such as methyl ethyl ketone, methyl isobutyl ketone and the like; aromatic solvents such as toluene, xylene and the like; ester solvents such as ethyl acetate, butyl acetate and the like; n-hexane, cyclohexanone, and so on.

In the present invention, the specific feature resides in that the weight of the solvent in the receiving layer is 1% or less of the solvent soluble components forming the receiving layer. In order to obtain this feature, there may be employed the method in which the solvent is evaporated by drying the image-receiving layer obtained as described above.

As such a drying method, the two-step drying method is preferred. Industrially, there can be employed the method in which the first drying is effected by a dryer equipped on a conventional printer, coater, etc., to a solvent weight in the receiving layer of about 5 to 10% (primary drying), and then the receiving layer is dired again to a solvent weight of 1% or less (secondary drying).

In this case, the conditions for redrying (secondary drying), for example, are by leaving the receiving layer to stand in an atmosphere of 60° C. for 10 days or longer, or in an atmosphere of 100° C. for 10 minutes or longer, or in an atmosphere of 120° C. for 2 minutes or longer.

As the method for measuring the solvent weight in the receiving layer, the solvent weight and the weight of the solvent soluble components in the resin composition during the formation of the receiving layer, and the solvent weight and the weight of the solvent soluble components after drying may be measured.

Also, in the present invention, for the purpose of further enhancing the sharpness of the transferred image by improvement of whiteness of the receiving layer as well as imparting writability to the surface of the image-receiving sheet and also preventing retransfer of the transferred image, a white pigment can be added in the receiving layer. By addition of a white pigment, the transfer of an image having a higher sharpness and excellent heat resistance and humidity resistance can be effected. Also, the whiteness luster possessed by the substrate can be prevented from damage (yellowing) by the color inherent in the resins by means of lamination of the resins of the receiving layer, the cushion layer, etc. . Particularly, the effect is great in a natural paper such as cast-coated paper, etc., which is inferior in whiteness, luster and smoothness when compared with synthetic paper.

As the white pigment, titanium oxide, zinc oxide, kaolin clay, etc. may be employed, and these can be also employed as a mixture of two or more kinds. The amount of the white pigment added may be preferably 5 to 50 parts by weight per 100 parts by weight of the resin constituting the receiving layer.

In the present invention, a UV-ray absorber can be also added in the above receiving layer. By the addition of a UV-ray absorber, the light resistance adsorbed by dyeing can be further improved. As the UV-ray absorber, there may be included benzophenone type, hindered amine type, benzotriazole type absorbers, etc. The amount of UV-ray absorber added may be about 0.05 to 5 parts by weight per 100 parts by weight of the resin constituting the receiving layer.

The image-receiving sheet of the present invention can incorporate a mold release agent in the receiving layer for improving the releasability from the heat transfer sheet. As the mold release agent, there may be employed solid waxes such as polyethylene wax, amide wax, Teflon powder, etc., fluorine type, phosphoric acid ester type surfactants, silicone oil, etc., preferably silicone oil.

As the above silicone oil, oily types can be also used, but those of the cured type are preferred. Examples of the cured type silicone oils may include the reaction-cured type, the photocured type, the catalyst cured type, etc., but the silicone oils of the reaction cured type are particularly preferred. As the reaction-cured type of silicone oil, the product obtained by the reaction curing of an amino-modified silicone oil and an epoxy-modified silicone oil are preferred. The amount of these cured-type silicon oils added may be preferably 0.5 to 30 parts by weight based on 100 parts by weight of the resin constituting the receiving layer.

Also, a mold release agent layer can be provided by coating a part or the whole of the surface of the receiving layer with the above mold release agent dissolved or dispersed in an appropriate solvent, followed by drying, etc. As the mold release agent constituting the mold release layer, the reaction-cured product of an amino-modified silicone oil and an epoxy-modified silicone oil as mentioned above is particularly preferred. The mold release agent layer should preferably have a thickness of 0.01 to 5 μm, particularly 0.05 to 2 μm. The mold release agent layer may be provided on either part or the whole of the surface of the receiving layer. When the mold release agent is provided on a part of the receiving layer surface, recording by dot-impact recording, thermally fusible transfer recording or recording with a pencil, etc. can be effected on the portion where no mold release agent layer is provided, while recording according to sublimation transfer on the portion where the mold release agent is provided. Thus, another recording system applied on the portion where no mold release agent is provided, can be performed in combination with the sublimation transfer recording system. Also, in the present invention, an intermediate layer can also be provided between the sheet substrate and the receiving layer, as described above. The intermediate layer 4 is either a cushioning layer or a porous layer depending on the constituent material, or also functions as an adhesive in some cases.

The cushioning layer is primarily composed of a resin having a 100% modulus as defined according to JIS-K-6301 of 100 kg/cm$^2$ or less. Here, if the above 100% modulus exceeds 100 kg/cm$^2$, due to too high a rigidity, sufficient contact between the heat transfer sheet and the image-receiving layer during printing cannot be maintained even if an intermediate layer can be formed by use of such a resin. On the other hand, the practical lower limit of the above 100% modulus is about 0.5 kg/cm$^2$.

Examples of resins satisfying the above conditions may include the following:

polyurethane resin, polyester resin, polybutadiene resin, polyacrylate resin, epoxy resin, polyamide resin, rosin-modified phenol resin, terpene-phenol resin, ethylene/vinyl acetate copolymer resin.

The above resin can be used as a single kind or as a mixture of two or more kinds, but since the above resin has a relative tackiness, if there is any trouble during processing, inorganic additives, for example, silica, alumina, clay, calcium carbonate, etc. or amide type substance such as stearic acid amide, etc. may be added.

The cushioning layer can be formed by optionally kneading the resin as described above together with other additives with a solvent, diluent, etc. to be formed into a coating material or an ink and drying it as the coating according to the known coating method or printing method, and its thickness may be 0.5 to 50 μm, more preferably about 2 to 20 μm. If the thickness is less than 0.5 μm, the roughness of the surface of the sheet substrate cannot be absorbed, thus having no effect, while on the contrary, if the thickness exceeds 50 μm, not only can no improvement of the effect be seen but also the receiving layer portion becomes too thick and protruded, thereby causing trouble during wind-up or piling, as well as not being economical.

Improvement of the contact between the heat transfer sheet and the image-receiving sheet by formation of such an intermediate layer may be considered to be due to deformation of the intermediate layer itself by the pressure during printing because of its low rigidity, and further it may be estimated that the resin as mentioned above generally has a lower glass transition point or softening point to be further lowered in rigidity than at normal temperature by the heat energy given during printing to become readily deformable, thus contributing to the improvement of contact.

For the porous layer, there may be employed (1) a layer obtained by coating of a liquid foamed by mechanical stirring of a synthetic resin emulsion such as of polyuretane, etc., a rigid rubber latex such as of methyl methacrylate-butadiene type, etc. on a substrate, followed by drying; (2) a layer obtained by the coating of a liquid formed by mixing of the above synthetic resin emulsion, the above synthetic rubber latex with a blowing agent on a substrate, followed by drying, (3) a layer obtained by coating a liquid formed by mixing a synthetic resin such as vinyl chloride plastisol, polyurethane, etc., or a synthetic rubber such as styrene-butadiene type, etc., with a blowing agent on a substrate, followed by expansion by heating, (4) a microporous layer comprising an agglomerated film microscopically obtained by coating a mixture of a solution containing a thermoplastic resin or a synthetic rubber dissolved in an organic solvent, and a non-solvent which is more difficult to vaporize when compared with said organic solvent, is compatibility with said organic solvent and is not soluble for the thermoplastic resin or the synthetic resin (including those composed mainly of water) on a substrate, followed by drying, etc. Since the layers of the above (1) to (3) have large cell sizes, and therefore, when the solution for formation of the receiving layer is coated and dried on said layer, there is the fear that the surface of the receiving layer formed by drying may be uneven. Accordingly, for obtaining a surface of the receiving layer having a small amount of the above unevenness and for transfer images of high uniformity, it is preferable to provide the above (4) microporous layer as the porous layer.

As the thermoplastic resin to be used in formation of the above microporous layer, there may be included saturated polyester, polyurethane, vinyl chloride/vinyl acetate copolymer, cellulose acetate propionate, etc., and also as the above synthetic rubber similarly used, styrene-butadiene type, isoprene type, urethane type synthetic rubbers may be employed. As the organic solvent and the non-solvent to be used in formation of the microporous layer, various solvents can be used, but generally, a hydrophilic solvent such as methyl ethyl ketone, alcohol is used as the organic solvent, and water as the non-solvent.

The porous layer in the present invention preferably has a thickness of 3 μm or more, with 5 to 20 μm being particularly preferable. A porous layer with a thickness less than 3 μm cannot exhibit the effects of the cushioning and thermal insulating properties.

Also, a lubricating layer can be provided on the back of the substrate. The image-receiving sheets may be sometimes piled on one another and transfer is performed by delivering the sheets one by one, and in this case, provision of a lubricating layer facilitates sliding mutually between the sheets, whereby each sheet can be accurately delivered. As the material for the lubricating layer, there may be employed methacrylate resins such as methyl methacrylate or corresponding acrylate resins, vinyl resins such as vinyl chloride-vinyl acetate copolymer.

Also, an antistatic agent can be incorporated in the image-receiving sheet. By incorporation of an antistatic agent, sliding between the sheets can be made smooth and at the same time giving the effect of preventing attachment of dust on the image-receiving sheet. The antistatic agent may be also incorporated in the substrate, the receiving layer or the lubricating layer, or alternatively an antistatic agent layer can be provided on the back of the surface. Preferably, it should be provided as the antistatic agent layer on the back of the substrate.

It is also possible to provide a detection mark on the image-receiving sheet in the present invention. The detection mark is very convenient for effecting registration between the heat transfer sheet and the image-receiving layer, and, for example, a detection mark capable of being detected by means of a photoelectric bulb detecting device can be provided by printing, etc., on the back of the substrate, etc.

In the present invention, when an intermediate layer, etc. is provided, the amount of the solvent contained in these layers may pose a problem, but so far as vagueness of the image after printing is concerned, there is no problem because it is influenced only by the amount of the solvent in the receiving layer. However, with respect to odor, there is a problem if a large amount of solvent is contained in the intermediate layer, etc. However, if the image-receiving sheet inclusive of the intermediate layer, etc. is subjected to redrying as described above, the amount of the solvent contained in the intermediate layer, etc. also becomes very little as it does in the receiving layer, whereby the problem of odor can be also eliminated.

The image-receiving sheet of the present invention having the constitution as described above, can be superposed on a heat transfer sheet so that the colorant layer of the heat transfer sheet may be in contact with the receiving layer of the image-receiving sheet, heated by means of a thermal head, etc. from the supporting material side of the heat transfer sheet, followed by peel-off of the transfer sheet, whereby the sublimable dye in the colorant layer can be transferred onto the receiving layer of the image-receiving sheet to effect recording of the image corresponding to image information on the image-receiving sheet.

The image-receiving sheet of the present invention is applicable to (1) formation of face pictures on simple ID cards, (2) formation of face pictures on name cards, (3) picture formation on the telephone cards, (4) premiums, (5) post cards, (6) advertisements for windows, (7) decorative advertisement boards, (8) various decorative articles, (9) labels for baggage, (10) labels for merchandise explanations, (11) labels for stationary goods, (12) indexes for audio cassette or video cassette, (13) OHP, etc.

The present invention is described in more detail by referring to Examples and Comparative Examples.

EXAMPLES 1-2, COMPARATIVE EXAMPLES 1-2

On a polyethylene terephthalate film with a thickness of 9 μm (produced by Toyobo, Japan: S-PET) applied on one surface with corona treatment as the support, an ink composition for heat transfer layer having the composition shown below was applied by wire bar coating and dried to a coated weight on drying of 1.0 g/m$^2$, and the back treatment was applied by adding one drop of a silicone oil (produced by Shinetsu Silicone, Japan: X-41 4003A) by a fountain pen filler and then spreading it over the whole surface, to provide a heat transfer sheet.

| Ink composition for heat transfer layer | |
|---|---|
| Disperse dye (produced by Nippon Kayaku, Japan: Kayaset Blue 714) | 4 parts by wt. |
| Polyvinyl butyral (produced by Sekisui Kagaku, Japan: S-LEC BX-l) | 4.3 parts by wt. |
| Toluene | 40 parts by wt. |
| Methyl ethyl ketone | 40 parts by wt. |
| Isobutanol | 10 parts by wt. |

Here, the polyvinyl butyral (BX-1) has a molecular weight of about 100,000, a Tg of 83° C. and a weight % at the vinyl alcohol portion of about 20%. The heat transfer layer obtained was found to be transparent and no particles were recognized at all even by observation by a microscope (magnification: ×400).

Next, by use of a synthetic paper with a thickness of 150 μm as the substrate (YUPO-FPG150, produced by Oji Yuka, Japan), an ink composition for receiving layer having the composition shown below, was applied thereon to a thickness on drying of 9.3 g/m$^2$, to prepare 4 kinds of the same image-receiving sheet. Drying was performed by passing the sheet through a drying hood of 120° C. of 20 m in length at a speed of 50 m/min.

The solvent weight on the basis of the solvent soluble component weight in the receiving layer of each image-receiving sheet after drying was 8.2% each. Next, redrying of each image-receiving sheet was conducted under the redrying conditions shown in Table 1. The solvent weight based on the solvent soluble components weight in the receiving layer in each sheet is shown in Table 1.

| Ink composition for receiving layer | |
|---|---|
| Vylon 600 (Polyester resin: produced by Toyobo, Japan) | 6 parts by wt. |
| Vinylite VAGH (Vinyl chloride-vinyl acetate copolymer: produced by Union Carbide Co.) | 4 parts by wt. |
| Amino-modified silicone (KF-393: produced by Shinetsu Silicone, Japan) | 0.125 parts by wt. |
| Epoxy-modified silicone (X-22-343: produced by Shinetsu Silicone, Japan) | 0.125 parts by wt. |
| Toluene | 70 parts by wt. |
| Methyl ethyl ketone | 10 parts by wt. |
| Cyclohexanone | 20 parts by wt. |

The heat transfer sheet and each image-receiving sheet were superposed so that the heat transfer layer was in contact with the receiving layer, and recording was performed from the support side of the heat transfer sheet by a thermal head under the conditions of an output of thermal head: 1W./1 dot, a pulse width; 0.3 to 4.5 msec., a dot density: 3 dots/mm. As the result, the printing densities shown in Table 1 were obtained.

Of the respective image-receiving sheets after printing, those of Examples 1, 2 gave no sensation of odor, but those of Comparative Examples 1, 2 gave the sensation of odor inherent in solvent. The results of storability of the respective image-receiving sheets are also listed together in Table 1.

TABLE 1

| | Redrying conditions | Solvent weight after redrying (%) | Printing density | Storability |
|---|---|---|---|---|
| Example 1 | left to sand at 60° C. for 10 days | 0.15 | 0.16–1.65 | no change at 40° C. for 30 days |
| Example 2 | left to stand at 120° C. for 2 min. | 0.73 | 0.16–1.66 | no change at 40° C. for 30 days |
| Comparative Example 1 | no redrying | 8.2 | 0.16–1.68 | vagueness of image, confirmed at 40° C. for 20 days |
| Comparative Example 2 | left to stand at 60° C. for one day | 1.3 | 0.16–1.68 | vagueness of image confirmed at 40° C. for 20 days |

As described above, the image-receiving sheet of the present invention has an extremely little amount of solvent in the receiving layer, and therefore there is no fear of the occurrence of density vagueness after printing, and an extremely sharp image can be maintained for a long time.

Also, due to the absence of odor, particularly outstanding effects can be exhibited when applied to sheets for the production of vessels for food.

What is claimed is:

1. An image-receiving sheet which is used in combination with a heat transfer sheet having a dye layer containing a dye transferable through melting or sublimiation with heat, said image-receiving sheet having a receiving layer for receiving the dye transferred from said heat transfer sheet on one surface of a sheet substrate, said receiving layer comprising a synthetic resin and the weight of the solvent in said receiving layer being 0.75% or less of the weight of the solvent soluble components forming the receiving layer.

2. An image-receiving sheet according to claim 1, wherein a mold release agent layer is provided on the surface of the receiving layer.

3. An image-receiving sheet according to claim 1, having an intermediate layer between the sheet substrate and the receiving layer.

* * * * *